US005565243A

United States Patent [19]

Mauer et al.

[11] Patent Number: 5,565,243

[45] Date of Patent: Oct. 15, 1996

[54] COLOR-CLEAR COMPOSITE COATINGS HAVING IMPROVED HARDNESS, ACID ETCH RESISTANCE, AND MAR AND ABRASION RESISTANCE

[75] Inventors: George W. Mauer, Brunswick Hills; James A. Meier, Rocky River; Lynne R. Stahl, Cleveland, all of Ohio

[73] Assignee: PPG Industries, Inc., Pittsburgh, Pa.

[21] Appl. No.: 432,296

[22] Filed: May 1, 1995

[51] Int. Cl.[6] ..... B05D 7/14

[52] U.S. Cl. ..... 427/407.2; 427/408; 427/410; 427/412; 427/412.1

[58] Field of Search ..... 427/409, 410, 427/407.1, 407.2, 407.3, 408, 411, 412, 412.1, 412.2, 412.3, 412.4, 412.5

[56] References Cited

U.S. PATENT DOCUMENTS

| | | | |
|---|---|---|---|
| 3,567,692 | 3/1971 | Haggis et al. | 260/75 |
| 4,102,942 | 7/1978 | Smith et al. | 260/836 |
| 4,147,679 | 4/1979 | Scriven et al. | 260/29.2 TN |
| 4,147,688 | 4/1979 | Makhlouf et al. | 260/33.6 |
| 4,303,581 | 12/1981 | Levine et al. | 260/18 PF |
| 4,375,498 | 3/1983 | Le Minez et al. | 428/416 |
| 4,403,003 | 9/1983 | Backhouse | 427/407.1 |
| 4,435,559 | 3/1984 | Valko | 528/73 |
| 4,615,779 | 10/1986 | McCollum et al. | 204/181.7 |
| 4,650,718 | 3/1987 | Simpson et al. | 428/413 |
| 4,681,811 | 7/1987 | Simpson et al. | 427/410 |
| 4,699,814 | 10/1987 | Ambrose et al. | 427/407.1 |
| 4,703,101 | 10/1987 | Singer et al. | 528/87 |
| 4,708,984 | 11/1987 | Forgione et al. | 525/127 |
| 4,708,985 | 11/1987 | Diamantoglou et al. | 525/166 |
| 4,710,542 | 12/1987 | Forgine et al. | 525/127 |
| 4,732,791 | 3/1988 | Blackburn et al. | 427/407.1 |
| 4,755,581 | 7/1988 | Blackburn et al. | 528/93 |
| 4,764,430 | 8/1988 | Blackburn et al. | 428/413 |
| 4,798,745 | 1/1989 | Martz et al. | 427/407.1 |
| 4,798,746 | 1/1989 | Claar et al. | 427/407.1 |
| 4,888,244 | 12/1989 | Masubuchi et al. | 428/416 |
| 4,892,906 | 1/1990 | Pham et al. | 524/730 |
| 4,917,955 | 4/1990 | Porter, Jr. et al. | 428/413 |
| 4,927,868 | 5/1990 | Schimmel et al. | 523/439 |
| 4,939,213 | 7/1990 | Jacobs III et al. | 525/329.9 |
| 5,006,653 | 4/1991 | Forgione et al. | 544/196 |
| 5,066,733 | 11/1991 | Martz et al. | 525/455 |
| 5,071,904 | 12/1991 | Martin et al. | 524/458 |
| 5,075,370 | 12/1991 | Kubitza et al. | 524/591 |
| 5,084,541 | 1/1992 | Jacobs III et al. | 528/45 |
| 5,089,561 | 2/1992 | Forgione et al. | 525/127 |
| 5,089,617 | 2/1992 | Forgione et al. | 525/196 |
| 5,137,972 | 8/1992 | Cook | 525/123 |
| 5,175,201 | 12/1992 | Forgione et al. | 524/257 |
| 5,182,355 | 1/1993 | Martz et al. | 528/75 |
| 5,214,086 | 5/1993 | Mormile et al. | 524/237 |
| 5,239,012 | 8/1993 | McEntire et al. | 525/327.7 |
| 5,256,452 | 10/1993 | McMonigal | 427/407 |
| 5,279,862 | 1/1994 | Corcoran et al. | 427/407 |
| 5,288,865 | 2/1994 | Gupta | 544/200 |
| 5,294,671 | 3/1994 | Szita et al. | 525/187 |
| 5,314,953 | 5/1994 | Corcoran et al. | 525/123 |
| 5,346,947 | 9/1994 | Guerro et al. | 524/591 |
| 5,352,755 | 10/1994 | Hughes | 528/45 |
| 5,356,973 | 10/1994 | Taljan et al. | 524/314 |
| 5,359,014 | 10/1994 | Forgione et al. | 525/455 |
| 5,369,153 | 11/1994 | Barsotti et al. | 523/429 |
| 5,384,367 | 1/1995 | Swarup et al. | 525/169 |
| 5,401,790 | 3/1995 | Poole et al. | 524/199 |

FOREIGN PATENT DOCUMENTS

| | | |
|---|---|---|
| 1262596 | 10/1989 | Canada . |
| 0549643B1 | 7/1993 | European Pat. Off. . |

*Primary Examiner*—Shrive Beck
*Assistant Examiner*—Erma Cameron
*Attorney, Agent, or Firm*—Kenneth J. Stachel

[57] ABSTRACT

A process for applying a color-plus-clear composite coating to a substrate is provided. The process comprises applying to the substrate a pigmented or colored film-forming composition to form a base coat and applying to the base coat a transparent film-forming composition to form a clear coat over the base coat. The base coat comprises a resinous binder; a tricarbamoyl triazine compound having the formula $C_3N_3$ $(NHCOXR)_3$, wherein X is nitrogen, oxygen, sulfur, phosphorus, or carbon, and R is a lower alkyl group having 1 to 12 carbon atoms, of mixtures of lower alkyl groups; and a pigment to act as the colorant. In a second embodiment of the invention, the base coat comprises a resinous binder, a capped polyisocyanate, and a pigment; and the clear coat comprises a polyepoxide and a polyacid crosslinking agent.

19 Claims, No Drawings

COLOR-CLEAR COMPOSITE COATINGS HAVING IMPROVED HARDNESS, ACID ETCH RESISTANCE, AND MAR AND ABRASION RESISTANCE

BACKGROUND OF THE INVENTION

The present invention relates to a process for preparing multi-layered coated articles comprising a pigmented or colored base coat and a transparent or clear topcoat.

Color-plus-clear coating systems involving the application of a colored or pigmented base coat to a substrate followed by the application of a transparent or clear topcoat to the base coat have become conventional as original finishes for automobiles. The color-plus-clear systems have outstanding gloss ant distinctness of image.

Because many geographic areas encounter acidic precipitation, resistance to etching by atmospheric acrid precipitation ("acid etch resistance") is becoming an increasingly desirable property for coatings, particularly automotive original equipment coatings. Original equipment manufacturers are requiring that coating systems demonstrate acid etch resistance.

In addition to the requirement of acid etch resistance, original equipment coatings must also demonstrate mar and abrasion resistance; i.e., the appearance of coating must not be detrimentally affected when the coating is contacted with an abrasive material. Mar and abrasion resistance is a desirable property particularly due to the popularity of commercial car washes there brushes are often used to wash car bodies.

A number of commercial coating systems which demonstrate acid etch resistance do not provide adequate mar and abrasion resistance. Microparticulate materials such as silica, metal sulfides, and crosslinked styrene-butadiene have been added to these coating systems to improve mar resistance, but gloss and distinctness of image of the systems is adversely affected due to light scattering at the particle surfaces.

It would be desirable to provide a color-plus-clear composite coating system which avoids the marring problems of the prior art systems while maintaining excellent acid etch resistance and appearance properties.

SUMMARY OF THE INVENTION

In accordance with the present invention, a process for applying a color-plus-clear composite coating to a substrate is provided. The process comprises applying to the substrate a pigmented or colored film-forming composition to form a base coat and applying to the base coat a transparent film-forming composition to form a clear coat over the base coat. The base coat comprises a resinous binder, a tricarbamoyl triazine compound having the formula $C_3N_3(NHCOXR)_3$, wherein X is nitrogen, oxygen, sulfur, phosphorus, or carbon, and R is a lower alkyl group having 1 to 12 carbon atoms, or mixtures of lower alkyl groups, and a pigment to act as the colorant. In a second embodiment of the invention, the base coat comprises a resinous binder, a capped polyisocyanate, and a pigment; and the clear coat comprises a polyepoxide and a polyacid crosslinking agent.

DETAILED DESCRIPTION

In a color-plus-clear application, a composite coating is applied to a substrate The process comprises applying to the substrate a pigmented or colored film-forming composition to form a base coat and applying to the base coat a second film-forming composition to form a transparent top coat, or clear coat, over the base coat. In a particularly preferred embodiment, additional coating layers such as a primer and/or a primer-surfacer may be applied to the substrate prior to application of the base coat.

The base coat and clear coat compositions used in the process of the present invention preferably are formulated into liquid high solids coating compositions, that is, compositions containing greater than 40 percent, preferably greater than 50 percent by weight resin solids. The solids content is determined by heating a sample of the composition to 105 –110° C. for 1–2 hours to drive off the volatile material and measuring relative weight loss. Although the compositions are preferably liquid coating compositions, they may be formulated as powder coating compositions.

The film-forming composition of the base coat can be any of the compositions useful in coatings applications, particularly automotive applications. The film-forming composition comprises a resinous binder, a tricarbamoyl triazine compound having the formula $C_3N_3(NHCOXR)_3$, wherein X is nitrogen, oxygen, sulfur, phosphorus, or carbon, and R is a lower alkyl group having 1 to 12 carbon atoms, or mixtures of lower alkyl groups, and a pigment to act as the colorant. Particularly useful resinous binders are acrylic polymers, polyethers, polyesters, including alkyds, and polyurethanes, which are described in detail in U.S. Pat. No. 4,650,718.

The acrylic polymers may be copolymers of one or more alkyl esters of acrylic acid or methacrylic acid optionally together with one or more other polymerizable ethylenically unsaturated monomers. These polymers are preferably of the thermosetting crosslinking type. Suitable alkyl esters of acrylic acid or methacrylic acid include methyl methacrylate, ethyl methacrylate, butyl methacrylate, ethyl acrylate, butyl acrylate, and 2-ethyl hexyl acrylate, as well as hydroxyl, acid, amine, amide, and other functional alkyl esters of acrylic and methacrylic acid capable of crosslinking with isocyanates. Other suitable copolymerizable ethylenically unsaturated monomers include vinyl aromatic compounds such as styrene and vinyl toluene; and nitriles such acrylonitrile and methacrylonitrile. Acrylic polymers can be prepared via organic solution polymerization techniques as are known to those skilled in the art.

Examples of polyether polyols are polyalkylene ether polyols which include those having the following structural formula: (i)

$$H\!+\!O\!+\!\underset{\underset{R}{|}}{CH}\!+\!_n\!]_m\!-\!OH$$

or (ii)

$$H\!+\!O\!+\!CH_2\!-\!\underset{\underset{R}{|}}{CH}\!+\!_n\!]_m\!-\!OH$$

where the substituent R is hydrogen or lower alkyl containing from 1 to 5 carbon atoms including mixed substituents, and n is typically from 2 to 6 and m is from 8 to 100 or higher. Included are poly(oxytetramethylene) glycols, poly(oxytetraethylene) glycols, poly (oxy-1,2-propylene) glycols, and poly(oxy-1,2-butylene) glycols.

Also useful are polyether polyols formed from oxyalkylation of various polyols, for example, glycols such as ethylene glycol, 1,6-hexanediol, and the like, or other higher polyols such as trimethylolpropane, pentaerythritol, and the like. Polyols of higher functionality which can be utilized as indicated can be made, for instance, by oxyalkylation of compounds such as sucrose or sorbitol. One commonly utilized oxyalkylation method is reaction of a polyol with an alkylene oxide, for example, propylene or ethylene oxide, in the presence of an acidic or basic catalyst.

preferred polyethers include those sold under the names TERATHANE and TERACOL, available from E. I. DuPont de Nemours and Company, Inc.

The resinous binder for the base coat composition may also be an alkyd resin or a polyester polyacid or polyol. Such polymers may be prepared in a known manner by condensation of polyhydric alcohols and polycarboxylic acids. Suitable polyhydric alcohols include ethylene glycol, propylene glycol, butylene glycol, 1,6-hexylene glycol, neopentyl glycol, diethylene glycol, glycerol, trimethylolpropane, and pentaerythritol.

Suitable polycarboxylic acids include succinic acid, adipic acid, azelaic acid, sebacic acid, maleic acid, fumaric acid, phthalic acid, tetrahydrophthalic acid, hexahydrophthalic acid, and trimellitic acid. Besides the polycarboxylic acids mentioned above, functional equivalents of the acids such as anhydrides where they exist or lower alkyl esters of the acids such as the methyl esters may be used.

Polyurethanes can also be used as the resinous binder of the base coat composition. Among the polyurethanes which can be used are polymeric polyols which are prepared by reacting the polyester polyols or acrylic polyols such as those mentioned above with a polyisocyanate such that the OH/NCO equivalent ratio is greater than 1:1 so that free hydroxyl groups are present in the product.

The organic polyisocyanate which is used to prepare the polyurethane polyol is preferably aliphatic. Diisocyanates are preferred, although higher polyisocyanates can be used in place of or in combination with diisocyanates.

Preferred resinous binders are polyesters and acrylic polymers having active hydrogen functionality such as hydroxyl, carboxyl, amido, primary and secondary amino, thiol, and the like.

The resinous binder in the base coat is present in amounts of about 30 percent to 90 percent by weight, more preferably from about: 65 to 80 percent by weight, based on total weight of resin solids in the base coat.

The tricarbamoyl triazine compound in the base coat has the formula $C_3N_3(NHCOXR)_3$, wherein X is nitrogen, oxygen, sulfur, phosphorus, or carbon, and R is a lower alkyl group having 1 to 12 carbon atoms, or mixtures of lower alkyl groups. X is preferably oxygen or carbon, more preferably oxygen. R preferably has one to eight carbon atoms, for example, methyl, ethyl, n-propyl, i-propyl, butyl, n-octyl, 2-ethylhexyl. R is preferably a mixture of methyl and butyl groups. Such compounds and the preparation thereof are described in detail in U.S. Pat. No. 5,084,541, incorporated herein by reference. These compounds are not aminoplasts, which are condensates obtained from the reaction of an aldehyde such as formaldehyde, such as acetaldehyde, crotonaldehyde, and benzaldehyde with an amine or amide such as melamine, urea, or benzoguanamine.

The tricarbamoyl triazine compound in the base coat is present in amounts of about 10 percent to 70 percent by weight, more preferably from about 20 to 35 percent by weight, based on total weight of resin solids in the base coat. It may be added to the film-forming base coat composition neat, that is, added by itself or in other resinous ingredients, or with solvents or other diluents.

The base coat also contains pigments to give it color. Compositions containing metallic flake pigmentation are useful for the production of so-called "glamour metallic" finishes chiefly upon the surface of automobile bodies. Proper orientation of the metallic pigments results in a lustrous shiny appearance with excellent flop. By "flop" is meant the visual appearance of brightness or lightness of the metallic coating with a change in viewing angle, that is, a change from 90 to 180 degrees. The greater the change from light to dark appearance with respect to viewing angle, the better the flop. Flop is important because it accentuates the lines of a curved surface such as on an automobile body. Suitable metallic pigments include, in particular, aluminum flake, copper bronze flake and mica.

Besides the metallic pigments, the base coating compositions of the present invention may contain non-metallic color pigments conventionally used in surface coatings including inorganic pigments such as titanium dioxide, iron oxide, chromium oxide, lead chromate, and carbon black, and organic pigments such as phthalocyanine blue and phthalocyanine green. In general, the pigment is incorporated into the coating composition in amounts of about 1 to 60 percent by weight based on weight of coating solids. The metallic pigment is employed in amounts of about 0.5 to 25 percent by weight based on weight of coating solids.

If desired, the base coat composition may contain additional materials well known in the art of formulated surface coatings. Examples are surfactants including cationic, anionic, and nonionic surfactants, flow control agents, UV stabilizers, thixotropic agents, fillers, antigassing agents, organic cosolvents, and other customary auxiliaries. Catalysts such as dibutyltin dilaurate and dibutyltin oxide may be used but are not necessary. These additional materials can constitute up to 40 percent by weight of the total weight of the coating composition.

The clear coat composition used in the process of the present invention may comprise an acrylosilane polymer, an acrylic polyol polymer, and, optionally, an alkylated melamine-formaldehyde crosslinking agent.

The acrylosilane polymer is prepared by polymerizing about 40 to 95 percent by weight ethylenically unsaturated non-silane containing monomers, and about 5 to 60 percent by weight ethylenically unsaturated alkoxy or acyloxy silane monomers, based on the weight of the acrylosilane. Suitable ethylenically unsaturated non-silane containing monomers include alkyl and aryl acrylates and methacrylates having 1 to 12 carbon atoms in the alkyl or aryl groups as are known to those skilled in the art. The alkyl groups also may be cycloaliphatic. Other suitable ethylenically unsaturated non-silane containing monomers include styrene, methyl styrene, acrylamide, acrylonitrile, and the like.

Suitable ethylenically unsaturated alkoxy or acyloxy silane monomers include acrylatoalkoxy silanes, methacrylatoalkoxy silanes vinylalkoxy silanes, and acyloxy silanes such as acrylatoxy silane, methacrylatoxy silane, and vinylacetoxy silanes.

Preferably, the acrylosilane polymer is present in the clear coat composition in amounts of about 10 to 90 percent by weight based on total weight of resin solids in the clear coat composition.

The acrylosiliane polymer typically has a weight average molecular weight of about 1,000 to 30,000 and a number average molecular weight of about 500 to 6,000.

The clear coat composition further includes an acrylic polyol polymer present in the film-forming composition in amounts of about 10 to 90 percent by weight based on total weight of resin solids in the clear coat composition.

The acrylic polyol polymer is prepared by polymerizing one or more hydroxyl functional alkyl acrylate or methacrylate monomers and up to about 80 percent by weight ethylenically unsaturated non-hydroxyl functional monomers, based on the weight of the acrylic polyol. Suitable hydroxyl functional alkyl acrylate or methacrylate monomers include hydroxy ethyl acrylate and methacrylate, hydroxypropyl acrylate and methacrylate, hydroxybutyl acrylate and methacrylate, and the like. Suitable ethylenically unsaturated non-hydroxyl functional monomers include alkyl and aryl acrylates and methacrylates having 1 to 16 carbon atoms in the alkyl or aryl groups as are known to those skilled in the art. Other suitable ethylenically unsaturated non-hydroxyl functional monomers include styrene, methyl styrene, acrylamide, acrylonitrile, and the like.

The acrylic polyol polymer preferably has a hydroxyl number of about 50 to 200, and a weight average molecular weight of about 1,000 to 200,000, preferably about 1,000 to 20,000.

The clear coat composition containing the acrylosilane polymer and acrylic polyol polymer may further include an alkylated melamine-formaldehyde crosslinking agent present in the film-forming composition in amounts of up to about 50 percent by weight based on total weight of resin solids in the clear coat composition.

The crosslinking agent may be monomeric or polymeric and may be partially or fully alkylated. The crosslinking agent typically has a weight average molecular weight of about 500 to 1500, and a number average molecular weight of about 300 to 600. Suitable crosslinking agents include CYMEL 1168, CYMEL 1161, and CYMEL 1158, all available from CYTEC Industries, Inc., and RESIMENE 755 and RESIMENE 4514, available from Monsanto Chemical Co.

In another embodiment of the invention, the clear coat composition used in the process of the present invention is a composition which may be single- or multi-package comprising a polyisocyanate and a polymer having at least one group that is reactive with isocyanate. The composition may further include active hydrogen containing reactive diluents as are known to those skilled in the art.

The polyisocyanate is preferably a fully capped polyisocyanate with substantially no free isocyanate groups. The polyisocyanate can be an aliphatic or an aromatic polyisocyanate or a mixture of the two. Diisocyanates are preferred, although higher polyisocyanates can be used in place of or in combination with diisocyanates.

Examples of suitable aliphatic diisocyanates are straight chain aliphatic diisocyanates such as 1,4-tetramethylene diisocyanate and 1,6-hexamethylene diisocyanate, and isocyanurates thereof. Also, cycloaliphatic diisocyanates can be employed. Examples include isophorone diisocyanate, isocyanurates of isophorone diisocyanate, and 4,4'-methylene-bis-(cyclohexyl isocyanate), tetramethyl xyxylene diisocyanate, and metaxyxylene diisocyanate.

Suitable capping agents include those well known in the art such as alcohols, lactams, oximes, malonic esters, pyrazoles, phenols, amines, pyrazoles and the like. Oximes are preferred.

The polyisocyanate is present in the film-forming composition in amounts of about 10 to 60 percent by weight, preferably 15 to 40 percent by weight based on total weight of resin solids in the clear coat composition.

Suitable polymers having at least one group that is reactive with isocyanates include those having hydroxyl groups, amino groups, thiol groups, hydrazide groups,, and the like. Preferably, the reactive group is hydroxyl. The polymer may be an acrylic, polyester, polyepoxide, polycarbonate, polyurethane, polyamide, polyimide, or polysiloxane. The polymer is preferably an acrylic. The polymer is present in the film-forming composition in amounts of about 40 to 90 percent by weight, preferably 60 to 85 percent by weight based on total weight of resin solids in the clear coat composition.

The clear coat composition used in the process of the present invention preferably comprises a polyepoxide and a polyacid crosslinking agent.

Preferably, the polyepoxide is present in the clear coat composition in amounts of about 10 to 90, preferably from about 25 to 50 percent by weight based on total weight of resin solids in the clear coat composition.

Among the polyepoxides which can be used are epoxy-containing acrylic polymers which are preferred, epoxy condensation polymers such as polyglycidyl ethers of alcohols and certain polyepoxide monomers and oligomers. Epoxy-containing acrylic polymers are preferred because they yield products which have the optimum combination of coating properties; i.e., smoothness, gloss, durability, and solvent resistance.

The epoxy-containing acrylic polymer is a copolymer of an ethylenically unsaturated monomer having at least one epoxy group and at least one polymerizable ethylenically unsaturated monomer which is free of epoxy groups.

Examples of ethylenically unsaturated monomers containing epoxy groups are those containing 1,2-epoxy groups and include glycidyl acrylate, glycidyl methacrylate, and allyl glycidyl ether.

Examples of ethylenically unsaturated monomers which do not contain epoxy groups are vinyl monomers and alkyl esters of acrylic and methacrylic acid containing from 1 to 20 atoms in the alkyl group such as those disclosed in U.S. Pat. No. 4,650,718, incorporated herein by reference.

The epoxy group-containing ethylenically unsaturated monomer is preferably used in amounts of from about 10 to 60, more preferably from20 to 50 percent by weight of the total monomers used in preparing the epoxy-containing acrylic polymer. Of the remaining polymerizable ethylenically unsaturated monomers, preferably from 40 to 90 percent, more preferably from 50 to 80 percent by weight of the total monomers, are the alkyl esters of acrylic and methacrylic acid containing from 1 to 20 carbon atoms in the alkyl group, and about 0 to 50 percent, preferably from about 5 to 40 percent based on the weight of total monomers. Other ethylenically unsaturated monomers are the vinyl aromatic compounds, nitriles, vinyl and vinylidene halides and vinyl esters.

The preparation of the epoxy-containing acrylic polymer may be conducted as disclosed in U.S. Pat. No. 4,650,718.

The epoxy-containing acrylic polymer typically has a number average molecular weight between about 1,000 and 20,000, preferably about 1,000 to 10,000, and more preferably about 1,000 to 5,000. The molecular weight is determined by gel permeation chromatography using a polystyrene standard.

Preferably, the polyepoxides have a glass transition temperature (Tg) less than 50° C., more preferably less than 30° C. The Tg is described in PRINCIPLES OF POLYMER CHEMISTRY, Flory, Cornell University Press, Ithaca, N.Y., 1953, pages 52–57. The Tg can be calculated as described by Fox in Bull. Amer. Physic. Society, 1,3, page 123 (1956). The Tg can be measured experimentally by using a penetrometer such as a DuPont 940 Thermomedian Analyzer. The Tg of the polymers, as used herein, refers to the calculated values unless otherwise indicated.

The epoxy condensation polymers which may be used are polyepoxides, that is, those having a 1,2-epoxy equivalency greater than 1, preferably greater than about 1 and up to about 3. The preferred polyepoxides are polyglycidyl ethers of aliphatic alcohols. These polyepoxides can be produced by etherification of alcohols such as those described in U.S. Pat. No. 4,650,718, with an epihalohydrin or dihalohydrin such as epichlorohydrin or dichlorohydrin in the presence of alkali.

In addition to the epoxy-containing acrylic polymers and epoxy condensation polymers described above, certain polyepoxide monomers and oligomers can also be used. Examples of these materials are described in U.S. Pat. No. 4,102,942 in column 3, lines 1–16. Specific examples of such low molecular weight polyepoxides are 3,4-epoxycyclohexylmethyl 3,4-epoxycyclohexanecarboxylate and bis(3,4-epoxycyclohexylmethyl) adipate. These low molecular weight polyepoxides may be used to increase the cure response and solids content of the curable compositions. When used, they are present in amounts up to 30 percent by weight based on the total weight of resin solids in the crosslinkable composition.

The clear coat composition used in the process of the present invention further includes a polyacid crosslinking agent present in the clear coat composition in amounts of about 10 to 90, preferably 25 to 75 percent by weight based on total weight of resin solids. The polyacid crosslinking agent has a high average acid functionality. More specifically, the polyacid crosslinking agent on average contains more than two acid groups per molecule, more preferably three or more, and most preferably four or more, such acid groups being reactive with the polyepoxide to form a crosslinked coating as indicated by its resistance to organic solvent. The parameter of greater than two acid groups per molecule is intended to encompass mixtures of polyacid crosslinking agents in which di-functional curing agents are mixed with tri- or higher functionality polyacid crosslinking agents. Polyacid crosslinking agent mixtures including up to about 50 percent of a di-functional curing agent with a tri-functional curing agent are suitable. Higher percentages of di-functional material can be used if the remainder of the curing agent mixture is higher than tri-functional or if the polyacid crosslinking agent mixture is used with a highly functional polyepoxide component. The acid functionality is preferably carboxylic acid, although acids such as phosphorus-based acid may be used. Preferably, the polyacid crosslinking agent is a carboxylic acid terminated material having, on average, greater than two carboxylic acid groups per molecule. Among the polyacid crosslinking agents which may be used are carboxylic acid group-containing polymers such as acrylic polymers, polyesters, and polyurethanes; oligomers such as ester group-containing oligomers, which are preferred; and monomers.

Suitable polyacid crosslinking agents include those described in U.S. Pat. Nos. 4,650,718; 4,681,811, and 4,703,101, incorporated herein by reference.

The equivalent ratio of the reactants present in the clear coat composition is adjusted such that for each equivalent of epoxy there are 0.3 to 3.0, preferably 0.75 to 1.5 equivalents of carboxyl (anhydride, if present, considered monofunctional).

The clear coat composition may also contain an anhydride, preferably an anhydride which is a liquid at 25° C. The presence of such an anhydride in the composition provides for improved cure response. Examples of suitable anhydrides include dodecenyl succinic anhydride and alkyl-substituted hexahydrophthalic anhydrides wherein the alkyl group contains up to 7 carbon atoms, more preferably up to 4 carbon atoms, such as methyl hexahydrophthalic anhydride. The amount of the anhydride which is used in the curable composition can vary from about 0 to 40 percent, preferably from about 5 to 25 percent by weight based on total weight of resin solids.

The clear coat composition may also contain a copolymer of an alpha olefin, such as 1-octene or 1-decene, and an olefinically unsaturated anhydride such as maleic anhydride. The anhydride group in such a polymer may be ring-opened with an alcohol such as ethanol. These copolymers improve the humidity resistance of the resultant cured coating. The use of these copolymers in polyepoxide-polyacid curable compositions is described more fully in U.S. Pat. No. 4,927,868. When used, the copolymers are present in amounts up to 25 percent, preferably 5 to 20 percent by weight based on total weight of resin solids of the curable composition.

To form multi-package or multi-component compositions in which the polyepoxide and polyacid crosslinking agent are present in separate packages and combined shortly before application, an esterification catalyst to promote cure can be included in the clear coat composition. A number of such catalysts are known in the art. These catalysts include basic materials such as secondary amine catalysts, for example, piperidine; tertiary amine catalysts such as N,N-dimethyldodecylamine, pyridine, and N,N-dimethylaniline; ammonium compounds, including tetrabutylammonium bromide, tetrabutylammonium hydroxide, and tetrabutylammonium acetate; phosphonium compounds, including ethyltriphenylphosphonium acetate and tetrabutyl phosphonium bromide; and other ammonium and phosphonium salts.

To form one-package compositions, the clear coat composition is substantially free of basic esterification catalyst. The high functionality associated with the polyepoxide and polyacid provide for sufficient cure response. Although the absence of catalyst may have a negative effect on the cure of the composition, it provides for a stable composition. In a preferred embodiment, the clear coat composition has no or only small amounts of basic esterification catalyst such that the composition is stable for a time sufficient to allow formulation of the composition as a single component; i.e., one-package composition.

In a particularly preferred embodiment, the basic esterification catalyst is present in the base coat composition. Though not intending to be bound by theory, it is believed that upon application of the clear coat to the base coat, the basic esterification catalyst migrates to the clear coat and initiates cure thereof upon heating. The presence of basic esterification catalyst in the base coat does not cause cure inhibition in the base coat. As is known in the art, properties of multilayered composite coatings can be deleteriously affected by different cure chemistries between coating layers which interfere with each other.

In a separate embodiment of the invention, the clear coat comprises a polyepoxide and a polyacid crosslinking agent, applied over a base coat which comprises a resinous binder, a capped polyisocyanate, and a pigment. In a particularly preferred embodiment the clear coat is a single-package composition and the base coat contains basic esterification catalyst.

Suitable resinous binders and pigments in the base coat are as described above. The polyisocyanate is preferably a fully capped polyisocyanate with substantially no free isocyanate groups. The polyisocyanate is preferably aliphatic. Diisocyanates are preferred, although higher polyisocyanates can be used in place of or in combination with diisocyanates. Biurets and isocyanurates are also suitable.

Examples of suitable aliphatic diisocyanates are straight chain aliphatic diisocyanates such as 1,4-tetramethylene diisocyanate and 1,6-hexamethylene diisocyanate. Also, cycloaliphatic diisocyanates can be employed. Examples include isophorone diisocyanate and 4,4'-methylene-bis-(cyclohexyl isocyanate). Metaxylylene diisocyanate is also suitable.

Isocyanate prepolymers, for example, reaction products of polyisocyanates with polyols such as neopentyl glycol and trimethylolpropane or with polymeric polyols such as polycaprolactone diols and triols (NCO/OH equivalent ratio greater than one) can also be used.

Any suitable aliphatic, cycloaliphatic, or aromatic alkyl monoalcohol may be used as a capping agent for the polyisocyanate including, for example, lower aliphatic alcohols such as methanol, ethanol, and n-butanol; cycloaliphatic alcohols such as cyclohexanol; aromatic-alkyl alcohols such as phenyl carbinol and methylphenyl carbinol. Glycol ethers may also be used as capping agents. Suitable glycol ethers include ethylene glycol butyl ether, diethylene glycol butyl ether, ethylene glycol methyl ether and propylene glycol methyl ether. Diethylene glycol butyl ether is preferred among the glycol ethers.

Other suitable capping agents include oximes such as methyl ethyl ketoxime, acetone oxime and cyclohexanone oxime, pyrazoles such as those described in U.S. Pat. No. 5,352,755, and lactams such as epsilon-caprolactam.

Other optional ingredients, such as plasticizers, antioxidants, UV light absorbers and stabilizers, may be formulated into the clear coat compositions used in the process of the present invention. When used, these ingredients are present (on an individual basis) in amounts up to 10 percent, preferably from about 0.1 to 5 percent by weight based on total weight of resin solids of the composition.

The base coat and clear coat compositions may be applied to a substrate by any conventional coating technique such as brushing, spraying, dipping or flowing, but spray applications are preferred because of superior gloss. Any of the known spraying techniques may be employed such as compressed air spraying, electrostatic spraying and either manual or automatic methods.

The color-plus-clear composite coatings can be applied over virtually any substrate including wood, metals, glass, cloth plastic, foam, including elastomeric substrates and the like. They are particularly useful in applications over metals and elastomeric substrates that are found on motor vehicles.

During application of the base coat composition to the substrate, a film of the base coat is formed on the substrate. Typically, the base coat thickness will be about 0.01 to 5, preferably 0.1 to 2 mils in thickness.

After application of the base coat to the substrate, a film is formed on the surface of the substrate by driving solvent, i.e., organic solvent or water, out of the base coat film by heating or by an air drying period. Preferably, the heating will only be for a short period of time, sufficient to ensure that the topcoat can be applied to the base coat without the former dissolving the base coat composition. Suitable drying conditions will depend on the particular base coat composition and on the ambient humidity with certain water-based compositions, but in general a drying time of from about 1 to 5 minutes at a temperature of about 80°–250° F. (20°–121° C.) will be adequate to ensure that mixing of the two coats is minimized. At the same time, the base coat film is adequately wetted by the topcoat composition so that satisfactory intercoat adhesion is obtained. Also, more than one base coat and multiple top coats may be applied to develop the optimum appearance. Usually between coats, the previously applied coat is flashed; that is, exposed to ambient conditions for about 1 to 20 minutes.

The clear top coat composition is applied to the base coat by any of the conventional coating techniques mentioned above, with spray applications preferred. Typically, the clear top coat is applied to the base coat via a wet-on-wet technique before the Base coat has been cured. The two coatings are then heated to conjointly cure both coating layers. In the curing operation, solvents are driven off and the film-forming materials of the coating composition are crosslinked. The heating or curing operation is usually carried out at a temperature in the range of from 160°–350° F. (71°–177° C.) but if needed, lower or higher temperatures may be used as necessary to activate crosslinking mechanisms. The thickness of the coating is usually from about 0.5–5 mils (12.7–127 microns), preferably 1.2–3 mils (30.5–76.2 microns).

The color-plus-clear composite coating systems used in the process of the present invention have excellent etch resistance properties. As used herein, the term "etch resistance" refers to the ability of a cured composition to resist etching by acids and water spotting. Etch resistance is typically evaluated by visual inspection of coated substrates after actual or simulated weathering. It should be noted that simulated weathering typically, but not always, corresponds to actual weathering. Moreover, it should be noted that cured compositions may have different etch. resistance properties when subjected to actual weathering in different geographic locations. An etch resistant composition, as discussed herein, refers to a composition which has etch resistant properties under actual weathering in at least one geographic site or which has etch resistant properties under simulated weathering.

The color-plus-clear composite coating systems used in the process of the present invention also have excellent mar or abrasion resistance properties, evaluated by measuring the gloss of coated substrates before and after abrading of the coated substrates using a consistent laboratory method.

The invention will further be described by reference to the following examples. Unless otherwise indicated, all parts are by weight.

EXAMPLES 1 THROUGH 4

Examples 1 through 4 illustrate the preparation of various pigmented coating compositions which are used in a coating process in accordance with the present invention. Example 1 is a control base coat containing conventional aminoplast resins. Example 2 illustrates the preparation of a base coat containing a tricarbamoyl triazine compound in place of aminoplast. Example 3 is generally the same as Example 2 with the addition of a basic esterification catalyst to the base coat, and Example 4 illustrates the preparation of a base coat containing a capped polyisocyanate in place of aminoplast.

The coating compositions of Examples 1 through 4 were prepared by mixing the ingredients together in the order listed and the compositions were spray applied in two coats to electrocoated steel panels at room temperature (67° F., 19.4° C.) and at a relative humidity between 30 and 35 percent, to achieve a dry film thickness of 0.65 mil (16.5 microns). After applying the Second coat, a 90 second flash was allowed before application of a polyepoxide-polyacid clear coat available from PPG industries, Inc., as DCT-5002. The clear coat was applied in two coats with a 90 second flash between coats, to achieve a dry film thickness of about 2 mil (50.8 microns). Each panel was given a 15 minute flash at room temperature and then cured for 30 minutes at 285° F. (140.5° C.).

Mar resistance of coated panels was measured using the following method: Gloss of coated panels is measured with a 20° BYK Gardner GLOSSGARD II glossmeter, available from Gardner Instrument Co. Coated panels are marred by applying a dry abrasive powder cleanser (Bon Ami™ cleanser, Faultless Starch/Bon Ami Co.) followed by ten double rubs to the surface with a wool felt cloth using a Crockmeter mar tester (available from Atlas Electric Devices Company). Twenty-degree gloss is read on the marred area of the panel after being washed with water and patted dry. The number reported is the percent gloss retention after marring; i.e., 100% ×marred gloss/original gloss.

The acid resistance of coated panels was measured using the following method: Test panels were spotted with one drop each of 0.625N hydrochloric acid, 0.625N sulfuric acid, sulfuric acid solution at pH 2, and a sulfuric acid solution at pH 3. The panels, with drops uncovered, were then placed in electric ovens at 120° F. (48.8° C.), and one drop of each acid solution was added to the panels at ten minute intervals. After 30 minutes the panels were removed from the ovens and were washed with soap and water and dried, then visually rated for degree of acid etch resistance.

Base coat formulations and composite coating properties are reported in Table I below.

TABLE I

| Example<br>Material | 1<br>Wt. | 2<br>Wt. | 3<br>Wt. | 4<br>Wt. |
|---|---|---|---|---|
| N-Butyl Acetate | 90 | 38 | 40 | 40 |
| TINUVIN 328[1] | — | 8 | 7 | 7 |
| Acrylic Microgel[2] | 95 | 95 | 86 | 86 |
| Bentone 34[3] | 33 | 33 | 30 | 30 |
| Polyester polyol[4] | 56 | 95 | 51 | 51 |
| RESIMENE CE-6526[5] | 136 | — | — | — |
| CYMEL 1130[6] | 94 | — | — | — |
| MR-225[7] | 32 | — | — | — |
| HC1170[8] | — | — | — | 342 |
| Acrylic Polyol[9] | 85 | 126 | 76 | 76 |
| Polyester polyol[10] | 50 | 95 | 52 | 52 |
| Denatured ethyl alcohol | 26 | 26 | 28 | 28 |
| Carbon Black dispersion[11] | 203 | 203 | 182 | 182 |
| Dodecylbenzylsulfonic Acid Solution[12] | 28 | — | — | — |
| Dodecyldimethylamine | — | — | 19 | — |
| Tricarbamoyl Triazine[13] | — | 343 | 190 | — |
| Xylene (reducing) | 85 | 75 | — | 110 |
| Base coat properties | | | | |
| Final Viscosity #4 Ford Cup | 16.6" | 17.8" | 18.4" | 17.7" |
| Composite properties | | | | |
| Mar Resistance | 21.5 | 48.9 | 69.2 | 59.6 |
| Acid Resistance | Good | Very Good | Excellent | Very Good |
| Knoop Hardness | 11.0 | 15.1 | 13.7 | 13.5 |

[1]2-(2'-Hydoxy-3',5'-ditert-amylphenyl) benzotriazole UV light stabilizer available from Ciba-Geigy Corp.
[2]Prepared according to U.S. Pat. No. 4,147,688.
[3]Organic derivative of Montmorillonite clay available from Rheox, Inc.
[4]A polyester polymer made up of about 65.0% trimethyl pentanediol and 35.0% hexahydrophthalic anhydride at a solids content of about 90.1% in n-butyl acetate.
[5]Partially methylated melamine-formaldehyde resin available from Monsanto Chemical Company.
[6]Partially butylated and methylated melamine-formaldehyde resin available from Cytec Industries, Inc.
[7]Polymeric butylated melamine-formaldehyde resin available from Monsanto Chemical Company.
[8]Capped polyisocyanate available from Olin Chemical Co.
[9]An acrylic polymer made up of about 40% hydroxypropyl acrylate, 20% styrene, 19% n-butyl acrylate, 18.5% n-butyl methacrylate, 2% glacial acrylic acid, and 0.5% methyl methacrylate.

TABLE I-continued

| Example<br>Material | 1<br>Wt. | 2<br>Wt. | 3<br>Wt. | 4<br>Wt. |
|---|---|---|---|---|

[10]Prepared according to U.S. Pat. No. 4,892,906, Example B.
[11]A dispersion of carbon in a 1:2 mixture of n-butyl acetate and an acrylic grind vehicle made up of about 29.9% styrene, 19.9% 2-ethyl hexyl acrylate, 19.4% butyl methacrylate, 17.9% methyl methacrylate, 10% hydroxyethyl acrylate, 1.9% methacrylic acid, 0.6% acrylic acid, and 0.4% propyleneimine; ground to a Hegman rating of 8+ and dispersed into a mixture of about 58% diisobutyl ketone and about 42% polyester polyol made up of about 65% trimethyl pentanediol and 35% hexahydrophthalic anhydride to a final composition of 16.1% carbon, 68.8% acrylic grind vehicle, and 15.1% polyester polyol, having a solids content of about 63.9%.
[12]A solution of 30% dodecylbenzylsulfonic acid in isopropyl alcohol.
[13]Compound having the formula $C_3N_3(NHCOOR)_3$, wherein R is a mixture of methyl and butyl groups.

The data in Table I indicates improvements in mar resistance, acid resistance, and hardness of composite coatings wherein the clear coat is a polyepoxide-polyacid composition and the base coat contains a tricarbamoyl triazine compound or a capped polyisocyanate in place of an aminoplast resin, as in the process of the present invention. The addition of a basic esterification catalyst to a base coat containing a tricarbamoyl triazine compound yields particularly improved results for mar and acid resistance (Example 3).

EXAMPLES 5 AND 6

Examples 5 and 6 illustrate the preparation of various pigmented coating compositions which are used in a coating process in accordance with the present invention. Example 5 is a control base coat containing conventional aminoplast resins. Example 6 illustrates the preparation of a base coat containing a tricarbamoyl triazine compound in place of aminoplast.

The coating compositions of Examples 5 and 6 were prepared and spray applied as in Examples 1 through 4 above. After applying the second coat, a 5 minute flash was allowed before application of a multi-package polyisocyanate clear coat available from PPG Industries, Inc., as WTKR2000. The clear coat was applied as in Examples 1 through 4 above, and the composite coatings cured for 30 minutes at 250° F. (121° C.).

Base coat formulations and composite coating properties are reported in Table II below.

TABLE II

| Example<br>Material | 5<br>Wt. | 6<br>Wt. |
|---|---|---|
| N-Butyl Acetate | 151 | 49 |
| TINUVIN 328 | — | 9 |
| Acrylic Microgel | 156 | 105 |
| Bentone 34 | 55 | 37 |
| Polyester polyol[14] | 93 | 62 |
| RESIMENE CE-6526 | 222 | — |
| CYMEL 1130 | 154 | — |
| MR-225 | 53 | — |
| Acrylic Polyol | 137 | 92 |
| Polyester polyol[15] | 95 | 64 |
| Denatured ethyl alcohol | 52 | 35 |
| Carbon Black | 332 | 232 |
| Dodecylbenzylsulfonic Acid Solution | 42 | — |
| Tricarbamoyl Triazine | — | 232 |
| Xylene (reducing) | 88 | — |

TABLE II-continued

| Example<br>Material | 5<br>Wt. | 6<br>Wt. |
|---|---|---|
| Base coat properties | | |
| Final Viscosity<br>#4 Ford Cup | 18.0" | 17.7" |
| Composite properties | | |
| Mar Resistance | 31.3 | 50.8 |
| Acid Resistance | Very Good | Excellent |
| Knoop Hardness | 10.4 | 14.1 |

[14]See Footnote 4.
[15]See footnote 10.

The data in Table II indicates significant improvements in mar resistance, acid resistance, and hardness of composite coatings wherein the clear coat is a multipackage polyisocyanate composition and the base coat contains a tricarbamoyl triazine compound or a capped polyisocyanate in place of an aminoplast resin, as in the process of the present invention.

We claim:

1. A process for applying a color-plus-clear composite coating to a substrate comprising applying to the substrate a pigmented or colored film-forming composition to form a base coat and applying to the base coat a transparent film-forming composition to form a clear coat over the base coat, wherein the base coat comprises a resinous binder; a tricarbamoyl triazine compound having the formula $C_3N_3(NHCOXR)_3$, wherein X is nitrogen, oxygen, sulfur, phosphorus, or carbon, and R is a lower alkyl group having 1 to 12 carbon atoms, or mixtures of lower alkyl groups; and a pigment to act as a colorant.

2. The process of claim 1 wherein the resinous binder is present in the base coat in amounts of about 30 to 90 percent by weight based on total weight of resin solids ill the base coat, and wherein the base coat is from a liquid high solids coating composition containing greater than 40 percent by weight resin solids, where the solids content is determined by heating a sample of the composition to 105°–110° C. for 1–2 hours to drive off the volatile material and measuring relative weight loss, and wherein this base coat composition further has up to 40 percent by weight of the total weight of the composition of additional materials.

3. The process of claim 1 wherein the resinous binder is present in the base coat in amounts of about 65 to 80 percent by weight based on total weight of resin solids in the base coat, and wherein the base coat is from a liquid high solids coating composition containing greater than 50 percent by weight resin solids, where the solids content is determined by heating a sample of the composition to 105°–110° C. for 1–2 hours to drive off the volatile material and measuring relative weight loss.

4. The process of claim 1 wherein the resinous binder is selected from the group consisting of acrylic polymers, polyesters, polyurethanes, and polyethers.

5. The process of claim 1 wherein the tricarbamoyl triazine compound is present in the base coat in amounts of about 10 to 70 percent by weight based on total weight of resin solids in the base coat.

6. The process of claim 1 wherein the tricarbamoyl triazine compound is present in the base coat in amounts of about 20 to 35 percent by weight based on total weight of resin solids in the base coat.

7. The process of claim 1 wherein the clear coat comprises a polyepoxide, a polyacid crosslinking agent, and, optionally, a basic esterification catalyst.

8. The process of claim 7 wherein the clear coat is a multi-package coating composition and contains a basic esterification catalyst.

9. The process of claim 7 wherein the polyepoxide in the clear coat is an epoxy-containing acrylic polymer..

10. The process of claim 7 wherein the polyepoxide is present in the clear coat in amounts of about 10 to 90 percent by weight based on total weight of resin solids in the clear coat.

11. The process of claim 9 wherein the epoxy-containing acrylic polymer is a copolymer of glycidyl acrylate or methacrylate and at least one other polymerizable ethylenically unsaturated monomer.

12. The process of claim 7 wherein the polyacid crosslinking agent is present in the clear coat in amounts of about 10 to 90 percent by weight based on total weight of resin solids in the clear coat.

13. The process of claim 7 wherein the polyacid crosslinking agent in the clear coat is a carboxylic acid-terminated material having an average of greater than two carboxylic acid groups per molecule.

14. The process of claim 13 wherein the carboxylic acid-terminated material is a carboxylic acid-terminated polyester.

15. The process of claim 7 wherein the base coat further contains basic esterification catalyst.

16. The process of claim 1 wherein a primer-surfacer coating is applied to the substrate prior to application of the base coat.

17. The process of claim 1 wherein the clear coat comprises an acrylosilane polymer, an acrylic polyol polymer, and optionally an alkylated melamine-formaldehyde crosslinking agent.

18. The process of claim 1 wherein the clear coat comprises a polyisocyanate, a polymer having at least one group that is reactive with isocyanate, and optionally an active hydrogen containing reactive diluent.

19. The process of claim 1 wherein the clear coat comprises a polyepoxide, a polyacid crosslinking agent in a one package composition which is substantially free of basic esterification catalyst.

* * * * *

UNITED STATES PATENT AND TRADEMARK OFFICE

CERTIFICATE OF CORRECTION

PATENT NO. : 5,565,243

DATED : October 15, 1996

INVENTOR(S) : Mauer et al.

It is certified that error appears in the above-identified patent and that said Letters Patent is hereby corrected as shown below:

Claim 2, column 13, line 36, please delete "ill" and insert --in--.

Signed and Sealed this

Twenty-seventh Day of January, 1998

*Attest:*

Bruce Lehman

BRUCE LEHMAN

*Attesting Officer*

*Commissioner of Patents and Trademarks*